US010718310B2

(12) United States Patent
Kono et al.

(10) Patent No.: US 10,718,310 B2
(45) Date of Patent: Jul. 21, 2020

(54) IGNITION APPARATUS

(71) Applicants: DENSO CORPORATION, Kariya, Aichi-pref (JP); THE UNIVERSITY OF TOKYO, Tokyo (JP)

(72) Inventors: Masaaki Kono, Nishio (JP); Daisuke Tanaka, Nishio (JP); Takaaki Sato, Nishio (JP); Akimitsu Sugiura, Kariya (JP); Mitsuhiro Tsue, Tokyo (JP); Shinji Nakaya, Tokyo (JP)

(73) Assignees: DENSO CORPORATION, Kariya (JP); THE UNIVERSITY OF TOKYO, Tokyo (JP)

( * ) Notice: Subject to any disclaimer, the term of this patent is extended or adjusted under 35 U.S.C. 154(b) by 136 days.

(21) Appl. No.: 15/755,709

(22) PCT Filed: Aug. 23, 2016

(86) PCT No.: PCT/JP2016/074523
§ 371 (c)(1),
(2) Date: Feb. 27, 2018

(87) PCT Pub. No.: WO2017/038561
PCT Pub. Date: Mar. 9, 2017

(65) Prior Publication Data

US 2018/0340506 A1 Nov. 29, 2018

(30) Foreign Application Priority Data

Aug. 31, 2015 (JP) ..... 2015-171140

(51) Int. Cl.
*F02P 3/00* (2006.01)
*F02P 3/01* (2006.01)
(Continued)

(52) U.S. Cl.
CPC ..... *F02P 3/0442* (2013.01); *F02P 3/053* (2013.01); *F02P 9/007* (2013.01); *F02P 15/02* (2013.01);
(Continued)

(58) Field of Classification Search
CPC ..... F02P 9/007
See application file for complete search history.

(56) References Cited

U.S. PATENT DOCUMENTS 9,151,265 B1 * 10/2015 Ikeda ..... B01D 53/32
2007/0266979 A1 * 11/2007 Nagamine ..... F02D 41/3041 123/143 B
2009/0031988 A1 * 2/2009 Shiraishi ..... F01L 13/0026 123/406.19
2009/0126684 A1 * 5/2009 Shiraishi ..... F02D 41/3041 123/406.12
(Continued)

FOREIGN PATENT DOCUMENTS

JP 2007-032349 2/2007
JP 2010-209868 9/2010
(Continued)

*Primary Examiner* — Phutthiwat Wongwian
*Assistant Examiner* — Arnold Castro
(74) *Attorney, Agent, or Firm* — Nixon & Vanderhye P.C.

(57) ABSTRACT

An ignition apparatus includes a plasma device, a first circuit, a second circuit, and a control unit. The plasma device produces a plasma discharge in an air-fuel mixture before an arc discharge is produced. The first circuit causes an ignition plug to start the arc discharge. The second circuit energizes a primary coil in a direction opposite to the direction of the energization by the first circuit during the arc discharge, to maintain energization of the secondary coil in the same direction as the direction of the energization started by an operation of the first circuit, to cause continuation of the arc discharge. The control unit controls operations of the first circuit, the second circuit, and the plasma device.

5 Claims, 7 Drawing Sheets

(51) Int. Cl.

| | |
|---|---|
| ***F02P 23/04*** | (2006.01) |
| ***F02P 3/04*** | (2006.01) |
| ***F02P 15/10*** | (2006.01) |
| ***F02P 3/05*** | (2006.01) |
| ***F02P 9/00*** | (2006.01) |
| ***F02P 15/02*** | (2006.01) |
| ***F02P 17/12*** | (2006.01) |
| ***F02P 15/08*** | (2006.01) |
| *F02P 5/04* | (2006.01) |
| *F02P 1/00* | (2006.01) |

(52) U.S. Cl.
CPC ..... *F02P 15/08* (2013.01); *F02P 15/10* (2013.01); *F02P 17/12* (2013.01); *F02P 23/04* (2013.01); *F02P 1/00* (2013.01); *F02P 5/045* (2013.01); *F02P 2017/121* (2013.01)

(56) References Cited

U.S. PATENT DOCUMENTS

| | | | | |
|---|---|---|---|---|
| 2009/0244802 | A1* | 10/2009 | Takeuchi | F02P 9/007 361/247 |
| 2010/0102728 | A1* | 4/2010 | Kato | F02P 9/007 315/111.21 |
| 2014/0048030 | A1* | 2/2014 | Ikeda | F02P 23/045 123/143 B |
| 2016/0102648 | A1 | 4/2016 | Nakayama et al. | |
| 2016/0341170 | A1* | 11/2016 | Ota | F01N 3/101 |

FOREIGN PATENT DOCUMENTS

| | | |
|---|---|---|
| JP | 2010-223189 | 10/2010 |
| JP | 2012-140970 | 7/2012 |
| JP | 2013-148098 | 8/2013 |
| JP | 2015-025397 | 2/2015 |

* cited by examiner

IGNITION APPARATUS

CROSS-REFERENCE TO RELATED APPLICATION

This application is the U.S. national phase of International Application No. PCT/JP2016/074523 filed Aug. 23, 2016, which designated the U.S. and claims priority to JP Patent Application No. 2015-171140 filed Aug. 31, 2015, the entire contents of each of which are hereby incorporated by reference.

TECHNICAL FIELD

The present disclosure relates to ignition apparatuses for internal combustion engines.

BACKGROUND ART

An ignition apparatus for an internal combustion engine has been known that includes an ignition coil having a primary coil and a secondary coil, and an ignition plug connected to the secondary coil. In such an ignition apparatus, an arc discharge is produced in an air-fuel mixture using energy supplied between electrodes of the ignition plug by electromagnetic induction resulting from energization and de-energization of the primary coil.

A known ignition apparatus includes a plasma device that produces a plasma discharge in an air-fuel mixture, and causes the air-fuel mixture to contain radicals by producing the plasma discharge, to improve the ignition performance of the air-fuel mixture (see, for example, PTL 1 and 2).

In recent years, for improved fuel efficiency, the combustion of a lean air-fuel mixture (having an air-fuel ratio higher than the stoichiometric air-fuel ratio) in internal combustion engines has been considered. However, with the lean air-fuel mixture, the amount of energy to be supplied between the electrodes of the ignition plug needs to be increased to reliably burn the fuel, which makes the electrodes of the ignition plug susceptible to wear.

With the configurations disclosed in PTL 1 and 2, the ignition performance is expected to improve as a result of containing the radicals. However, the kind, amount, and the like of radicals generated by the plasma discharge depends on the physical condition (temperature, pressure, etc.). Therefore, improvements to the ignition performance are not always expected for the lean air-fuel mixture. Thus, for the lean air-fuel mixture, the voltage to be applied to the electrodes of the ignition plug needs to be increased as a solution. Accordingly, the ignition apparatus including the plasma device also requires some measures to deal with the wear of the electrodes of the ignition plug. Note that in the ignition apparatus of Patent Literature 2, the ignition plug also serves as the plasma device, and thus the electrodes are significantly subject to wear.

CITATION LIST

Patent Literature

[PTL 1] JP 2013-148098 A

[PTL 2] JP 2012-140970 A

SUMMARY OF THE INVENTION

Technical Problem

An object of the present disclosure is to reduce wear of electrodes of an ignition plug in an ignition apparatus including a plasma device that produces a plasma discharge in an air-fuel mixture.

The ignition apparatus according to the present disclosure is used for an internal combustion engine and includes an ignition coil including a primary coil and a secondary coil, and an ignition plug connected to the secondary coil. And an arc discharge is produced in an air-fuel mixture using energy supplied between electrodes of the ignition plug by electromagnetic induction resulting from energization and de-energization of the primary coil.

The ignition apparatus of the present disclosure includes a plasma device, a first circuit, a second circuit, and a control unit, which will be described below.

The plasma device includes electrodes different from those of the ignition plug and produces a plasma discharge in the air-fuel mixture before the arc discharge is produced.

The first circuit energizes and de-energizes the primary coil to cause the ignition plug to start the arc discharge.

The second circuit energizes the primary coil in a direction opposite to the direction of the energization by the first circuit during the arc discharge started by the operation of the first circuit. In this way, the second circuit sequentially supplies energy between the electrodes of the ignition plug by maintaining energization of the secondary coil in the same direction as the direction of the energization started by an operation of the first circuit so that the arc discharge continues.

The control unit controls operations of the first circuit, the second circuit, and the plasma device.

As a result of including the first circuit and the second circuit, the ignition apparatus according to the present disclosure is capable of adjusting the period in which the energy is supplied between the electrodes of the ignition plug and the amount of energy supplied per unit time, for example. Therefore, in the ignition apparatus according to the present disclosure, the arc discharge once produced can continue while controlling the amount of energy to be supplied between the electrodes of the ignition plug. Thus, the ignition apparatus according to the present disclosure can reduce wear of the electrodes of the ignition plug.

The inventors conducted research and development on the combination of the plasma device with the ignition apparatus including the first circuit and the second circuit. As a result, the inventors acquired the following knowledge and found that, regarding the reduction in wear of the electrodes of the ignition plug, this produces a synergetic effect that is higher than or equal to the effect of mere combination.

Specifically, it was found that when the plasma discharge is produced in the air-fuel mixture on the condition that a constant amount of energy is supplied to the ignition plug, the amount of heat generation increases as the energy supply period becomes shorter (see FIG. 5).

Thus, when the plasma discharge is produced in the air-fuel mixture, the period in which the energy is supplied to the ignition plug can be short, and the amount of energy supplied can be small, compared to when the plasma discharge is not produced. Thus, the ignition apparatus including the plasma device can reduce wear of the electrodes of the ignition plug.

DESCRIPTION OF THE EMBODIMENTS

An embodiment for implementing the techniques according to the present disclosure will be described using an Example. Note that the Example described below shows a specific example of the embodiment. Thus, the technical scope of the present disclosure is not limited to the details of the following Example.

[Configuration of Ignition Apparatus]

Figure 1:
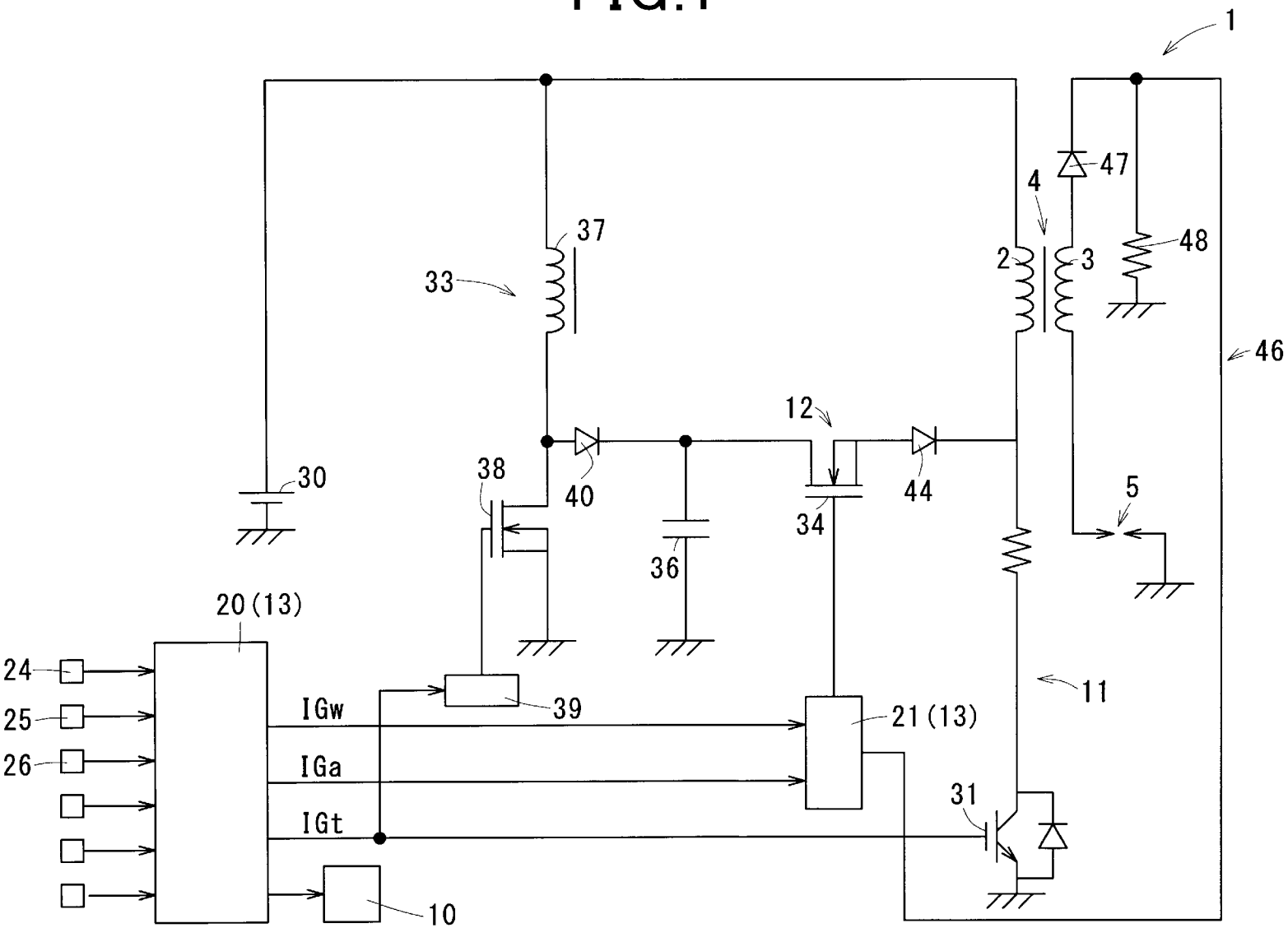
FIG. 1 is a configuration diagram of an ignition apparatus, according to an Example.
Figure 2:
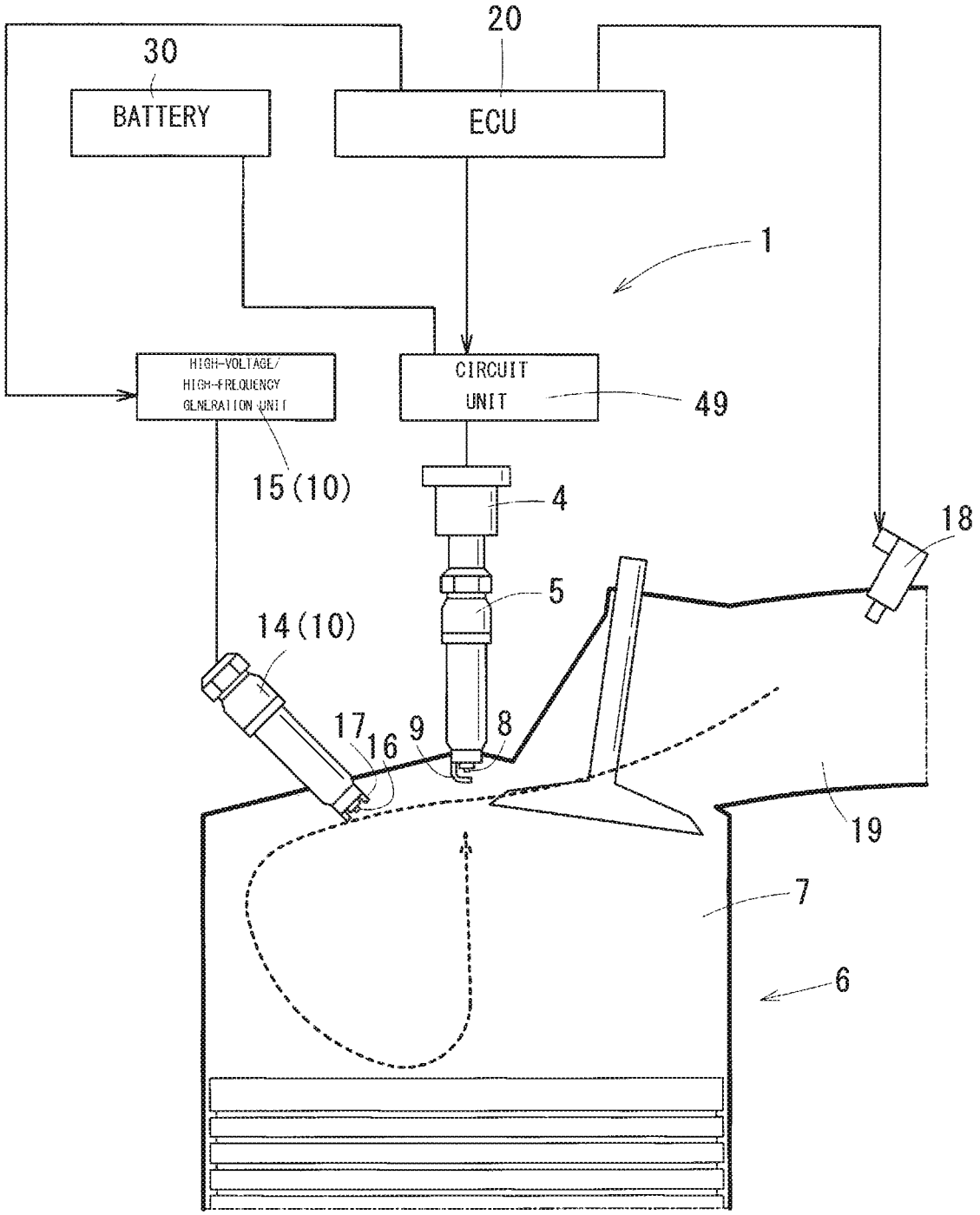
FIG. 2 is an overall configuration diagram illustrating an ignition apparatus and an internal combustion engine, according to the Example.

An ignition apparatus according to the present Example will be described with reference to FIGS. 1 and 2. Ignition apparatus 1 according to the present Example is mounted on an internal combustion engine 6 for vehicle travel. The ignition apparatus 1 ignites an air-fuel mixture in a combustion chamber 7 at a predetermined ignition timing. The ignition apparatus 1 includes an ignition coil 4 including a primary coil 2 and a secondary coil 3, and an ignition plug 5 connected to the secondary coil 3. The ignition apparatus 1 produces an arc discharge in the air-fuel mixture using energy supplied to the ignition plug 5 by electromagnetic induction resulting from energization and de-energization of the primary coil 2.

The ignition plug 5 has a well-known configuration that includes a center electrode 8 connected to one end of the secondary coil 3, and an earth electrode 9 earthed via a cylinder head, or the like of the internal combustion engine 6. The ignition plug 5 produces the arc discharge between the center electrode 8 and the earth electrode 9 by energy generated in the secondary coil 3. In the subsequent description, there are cases where the center electrode 8 and the earth electrode 9 are referred to simply as electrodes 8 and 9 when the distinction is not needed.

The internal combustion engine 6 is capable of lean-burn using gasoline as fuel, for example, and is provided in such a way that a swirling flow of the air-fuel mixture such as a tumble flow and a swirl flow is created in the combustion chamber 7.

The ignition apparatus 1 according to the present Example will now be described in detail.

The ignition apparatus 1 includes a plasma device 10, a first circuit 11, a second circuit 12, a control unit 13, and the like such as those described below.

The plasma device 10 has a well-known configuration that includes a discharge unit 14 and a high-voltage/high-frequency generation unit 15. The discharge unit 14 is provided separately from the ignition plug 5, and produces a plasma discharge in the air-fuel mixture before the ignition plug 5 produces the arc discharge.

The discharge unit 14 includes a center electrode 16 and an earth electrode 17 which is earthed via the cylinder head or the like of the internal combustion engine 6. The discharge unit 14 produces the plasma discharge in the air-fuel mixture by applying, between the center electrode 16 and the earth electrode 17, a voltage from the high-voltage/high-frequency generation unit 15. The center electrode 16 and the earth electrode 17 of the discharge unit 14 are provided in the combustion chamber 7. The high-voltage/high-frequency generation unit 15 applies, between the center electrode 16 and the earth electrode 17, an alternating-current voltage corresponding to a command from the control unit 13. In the subsequent description, there are cases where the center electrode 16 and the earth electrode 17 are referred to simply as electrodes 16 and 17 when the distinction is not needed.

A fuel injection valve 18 injects fuel. The fuel injection valve 18 is provided in an intake air passage 19 through which intake air is guided into the combustion chamber 7. The intake air passage 19 is located upstream of the discharge unit 14 in the flow of the air-fuel mixture. Note that after being subject to the plasma discharge produced by the discharge unit 14, the air-fuel mixture reaches the ignition plug 5, for example, by the tumble flow, and is subject to the arc discharge (see the dotted line in FIG. 2).

The first circuit 11 energizes and de-energizes the primary coil 2 to cause the ignition plug 5 to start the arc discharge. The second circuit 12 energizes the primary coil 2 in a direction opposite to the direction of the energization by the first circuit 11 during the arc discharge started by the operation of the first circuit 11. In this way, the second circuit 12 sequentially supplies energy between the electrodes of the ignition plug 5 by maintaining the energization of the secondary coil 3 in the same direction as the direction of the energization started by the operation of the first circuit 11 so that the arc discharge continues.

The control unit 13 controls operations of the plasma device 10, the first circuit 11, and the second circuit 12. The control unit 13 includes an electronic control unit (hereinafter referred to as ECU 20), an energization driver 21, and the like such as those described below.

The ECU 20 controls the entire internal combustion engine 6. The ECU 20 outputs various signals such as an ignition signal IGt and a discharge continuous signal IGw, which will be described later, and controls the energization of the primary coil 2. By controlling the energization of the primary coil 2, the ECU 20 manages electrical energy to be delivered to the secondary coil 3, thereby controlling the arc discharge of the ignition plug 5. Furthermore, the ECU 20 outputs a control signal to the high-voltage/high-frequency generation unit 15, thereby controlling the plasma discharge of the discharge unit 14.

For example, various sensors that detect parameters indicating the operating state, control state, and the like of the internal combustion engine 6 are mounted on a vehicle. The ECU 20 receives signals from these various sensors. The ECU 20 includes an input circuit, a central processing unit (CPU), various memories, an output circuit, and the like such as those described below. The input circuit processes the received signals. On the basis of the received signals, the CPU performs a control process, an arithmetic process, and the like related to the control of the internal combustion engine 6. The various memories store and hold data, programs, and the like necessary for the control of the internal combustion engine 6. On the basis of the result of processing by the CPU, the output circuit outputs a signal necessary for the control of the internal combustion engine 6.

Note that the various sensors that output the signals to the ECU 20 are, for example, a rotational speed sensor 24, an intake air pressure sensor 25, and an air-fuel ratio sensor 26. The rotational speed sensor 24 detects the rotational speed of the internal combustion engine 6. The intake air pressure sensor 25 detects the pressure of an intake air that is taken into the internal combustion engine 6. The air-fuel ratio sensor 26 detects the air-fuel ratio of the air-fuel mixture.

On the basis of parameter detection values obtained from these various sensors, the ECU 20 performs ignition control of the ignition apparatus 1, plasma discharge control of the plasma device 10, fuel injection control of fuel injection valve 18, and the like.

The first circuit 11 is configured such that the positive terminal of a battery 30 and a first terminal of the primary coil 2 are connected to each other and a second terminal of the primary coil 2 is connected to the earth. Furthermore, in the first circuit 11, a switch for starting the discharge (hereinafter referred to as first switch 31) is disposed on the earth side (low-potential side) of the second terminal of the primary coil 2.

The first circuit 11 turns on and off the first switch 31 to cause the primary coil 2 to store energy. Then, using the energy stored in the primary coil 2, the first circuit 11 causes a high voltage to be generated at the secondary coil 3, thereby causing the ignition plug 5 to start the arc discharge.

In the subsequent description, there are cases where the arc discharge generated as a result of the operation of the first circuit 11 is referred to as main ignition. As the direction of energization of the primary coil 2 (the direction of a primary current), the direction from the battery 30 to the first switch 31 is referred to as positive.

Specifically, the first circuit 11 turns on the first switch 31 in the period in which the ignition signal IGt is provided from the ECU 20. Thus, the first circuit 11 applies the voltage of the battery 30 to the primary coil 2, thereby allowing passage of a positive primary current so that magnetic energy is stored in the primary coil 2. Thereafter, the first circuit 11 turns off the first switch 31, thereby causing the secondary coil 3 to generate a high voltage by electromagnetic induction so that the main ignition occurs.

Note that the first switch 31 is, for example, a power transistor, a metal-oxide-semiconductor (MOS) transistor, or a thyristor. The ignition signal IGt indicates a period in which the energy is stored in the primary coil 2 and an ignition start timing in the first circuit 11.

The second circuit 12 is configured so as to be connected to the first circuit 11, between the primary coil 2 and the first switch 31. Furthermore, in the second circuit 12, a switch that allows and interrupts supply of power from a booster circuit 33 to the primary coil 2 (hereinafter referred to as second switch 34) is disposed.

The booster circuit 33 boosts the voltage of the battery 30 in the period in which the ignition signal IGt is provided from the ECU 20, and the boosted voltage is stored in a capacitor 36.

Specifically, the booster circuit 33 includes the capacitor 36, a choke coil 37, a booster switch 38, a booster driver 39, a diode 40, and the like.

The choke coil 37 has one end connected to the positive terminal of the battery 30. The choke coil 37 is intermittently energized and de-energized by the booster switch 38. The booster driver 39 turns on and off the booster switch 38 by providing a control signal to the booster switch 38. The booster switch 38 is, for example, a MOS transistor. The capacitor 36 stores, as electrical energy, magnetic energy generated at the choke coil 37, by turning on and off of the booster switch 38.

Note that the booster driver 39 repeatedly turns on and off the booster switch 38 in a predetermined cycle in the period in which the ignition signal IGt is provided from the ECU 20. The diode 40 prevents the energy stored in the capacitor 36 from flowing back toward the choke coil 37.

The second circuit 12 includes a second switch 34 and a diode 44.

The second switch 34 allows and interrupts supply of the energy stored in the capacitor 36 to the primary coil 2 from the negative end of the primary coil 2. The second switch 34 is, for example, a MOS transistor.

The diode 44 prevents an electric current from flowing back from the primary coil 2 toward the second switch 34.

The second switch 34 is turned on according to a control signal provided from the energization driver 21, thereby supplying the energy from the booster circuit 33 toward the negative end of the primary coil 2.

The energization driver 21 controls the energy that is supplied from the capacitor 36 to the primary coil 2 by turning on and off the second switch 34 in the period in which the discharge continuous signal IGw is provided. Thus, the energization driver 21 controls a secondary current which is the amount of electricity in the secondary coil 3 when energized.

Note that the discharge continuous signal IGw indicates a period for which the arc discharge produced as the main ignition continues.

Accordingly, during the arc discharge started by the operation of the first circuit 11, the second circuit 12 energizes the primary coil 2 in a direction opposite to the direction of the energization by the first circuit 11. In this way, the second circuit 12 sequentially supplies energy between the electrodes of the ignition plug 5 by maintaining the secondary current in the same direction as the direction of the energization started by the operation of the first circuit 11 so that the arc discharge continues.

In the subsequent description, there are cases where the arc discharge continuing from the main ignition by the operation of the second circuit 12 is referred to as a continuous spark discharge.

The ECU 20 provides, to the energization driver 21, an electric current command signal IGa indicating a command value of a secondary current. The energization driver 21 controls the secondary current on the basis of the provided electric current command signal IGa.

As described above, the secondary coil 3 has a first end connected to the center electrode 8 of the ignition plug 5. A second end of the secondary coil 3 is connected to a F/B circuit 46 which detects a secondary voltage and a secondary current generated at the second coil 3 and provides feedback to the control unit 13.

Note that the second end of the secondary coil 3 is connected to the F/B circuit 46 via a diode 47 which restricts the direction of the secondary current to one direction. Furthermore, a shunt resistor 48 for detecting the secondary current is connected to the F/B circuit 46.

The energization driver 21 controls turning on and off of the second switch 34 on the basis of a detection value of the secondary current fed back thereto and a command value of the secondary current specified from the electric current command signal IGa. For example, the energization driver 21 sets, as threshold values, an upper limit value and a lower limit value for the detection value of the secondary current on the basis of the command value. The energization driver 21 starts or stops the output of the control signal in accordance with the result of comparison between the detection value and the threshold values (the upper limit value and the lower limit value).

Specifically, when the detection value of the secondary current exceeds the upper limit, the energization driver 21 stops the output of the control signal. When the detection value of the secondary current falls below the lower limit, the energization driver 21 starts the output of the control signal.

Note that the first circuit 11, the second circuit 12, the F/B circuit 46, and the energization driver 21 are grouped into one module as a circuit unit 49. The ignition plug 5, the ignition coil 4, and the circuit unit 49 are provided in each cylinder. Likewise, the plasma device 10 is also provided in each cylinder.

[Operations of Ignition Apparatus]

Operations of the ignition apparatus 1 according to the present Example will be described with reference to FIG. 3.

Note that the control unit 13 has control modes for the first circuit 11 and the second circuit 12. Specifically, the control unit 13 has, as the control modes, a first mode to be used when the plasma device 10 is operated and a second mode to be used when the plasma device 10 is not operated. An example in which the first mode is used will be described below.

Figure 3:
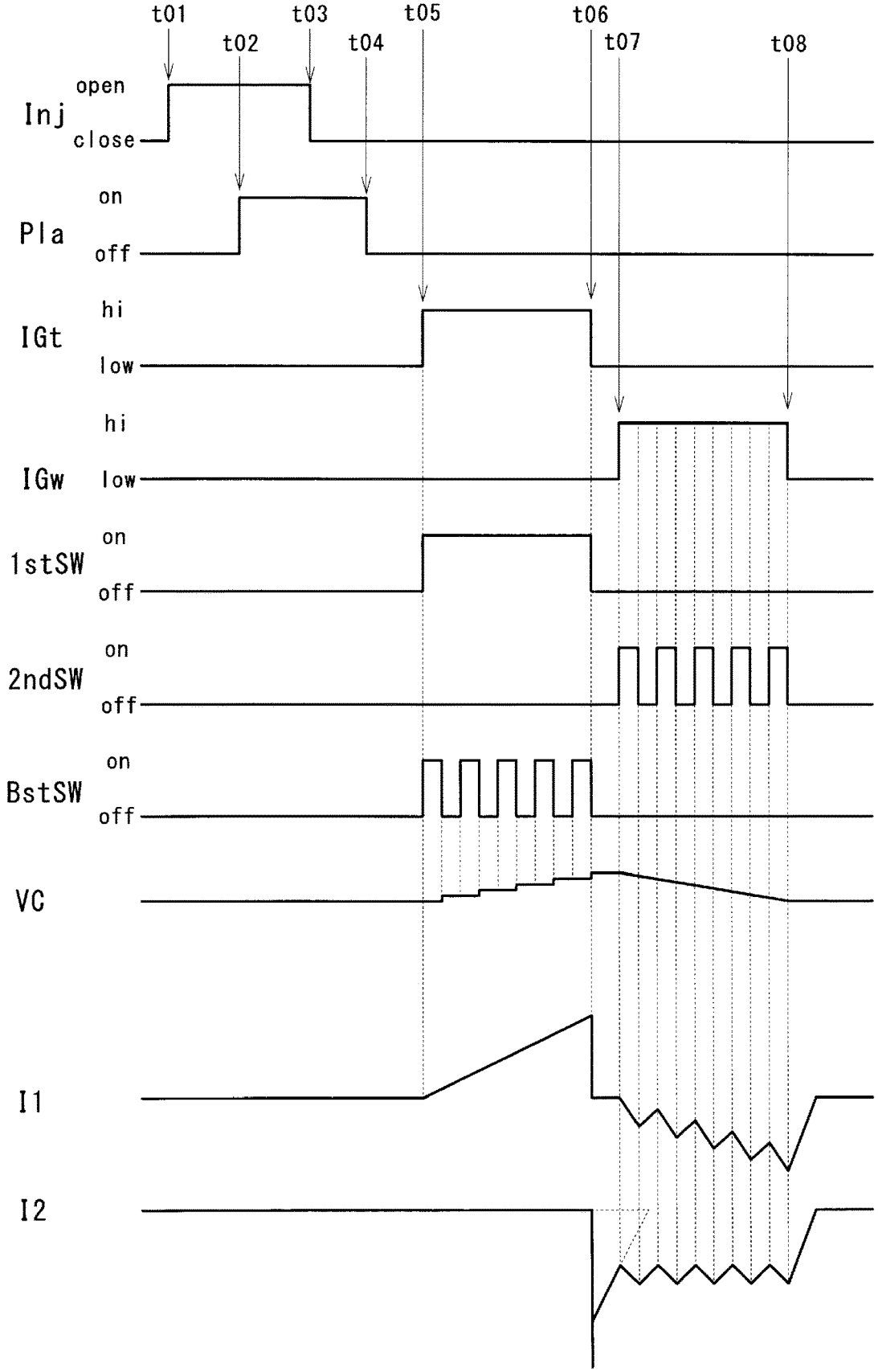
FIG. 3 is a timing diagram illustrating an operation of an ignition apparatus, according to the Example.

In FIG. 3, open and close in "Inj" represent opening and closing of an injection port of the fuel injection valve 18, and on and off in "Pla" represent an operating state (in operation/not in operation) of the plasma device 10. Furthermore, hi and low in "IGt" represent an input state of the ignition signal IGt, and hi and low in "IGw" represent an input state of the discharge continuous signal IGw. Furthermore, on and off in "1 stSW" represent an operating state of the first switch 31, on and off in "2 ndSW" represent an operating state of the second switch 34, and on and off in "BstSW" represent an operating state of the booster switch 38. Furthermore, "VC" represents a charging voltage of the capacitor 36. Furthermore, "I1" represents a primary current (the value of the electric current flowing through the primary coil 2), and "I2" represents a secondary current (the value of the electric current flowing through the secondary coil 3).

First, in accordance with the control signal from the ECU 20, the fuel injection valve 18 continues to inject and supply the fuel through the injection port between when the injection port opens up and when the injection port is closed (time t01 to time t03).

Subsequently, in the middle of the period for which the injection port of fuel injection valve 18 is open (time t01 to time t03), the plasma device 10 starts operating (time t02) to generate plasma in the air-fuel mixture. The plasma device 10 continues to operate for a predetermined period even after the fuel supply through the injection port is blocked (even after time t03), and is then stopped (time t04).

Note that the period between when the injection port of the fuel injection valve 18 opens up and when the operation of the plasma device 10 starts (time t01 to time t02) is set, for example, on the basis of the distance between the fuel injection valve 18 and the discharge unit 14. The period between when the injection port of the fuel injection valve 18 opens up and when the operation of the plasma device 10 is stopped (time t03 to time t04) is also set in the same or similar manner.

Furthermore, the period between when the injection port of the fuel injection valve 18 opens up and when the ignition signal IGt switches from low to high (time t01 to time t05) is set, for example, on the basis of the positional relationship between the fuel injection valve 18 and the ignition plug 5 and a swirling flow generated in the air-fuel mixture.

Next, when the ignition signal IGt switches from low to high (time t05), the first switch 31 is kept on (1 stSW: on) for the period for which the ignition signal IGt is high (time t05 to time t06). Thus, a positive primary current I1 flows and the primary coil 2 stores energy in the period for which the ignition signal IGt is high (time t05 to time t06). In this period (time t05 to time t06), when the charging voltage (VC) of the capacitor 36 falls below a predetermined value, the booster switch 38 is repeatedly turned on and off so that boosted energy is stored in the capacitor 36.

Eventually, when the ignition signal IGt switches from high to low (time t06), the first switch 31 is turned off (1 stSW: off), interrupting the energization of the primary coil 2. Accordingly, a high voltage is generated at the secondary coil 3 by electromagnetic induction, and the main ignition occurs at the ignition plug 5.

After the main ignition occurs at ignition plug 5, the secondary current I2 is attenuated in the shape of a substantially triangular waveform (refer to the dotted line for I2). Subsequently, before the secondary current I2 reaches the lower threshold limit value (the lower limit value), the discharge continuous signal IGw switches from low to high (time t07).

When the discharge continuous signal IGw switches from low to high (time t07), the second switch 34 is controlled to be turned on and off (2 ndSW: on and off). Accordingly, the energy stored in the capacitor 36 is sequentially supplied to the negative end of the primary coil 2, and the primary current I1 flows from the primary coil 2 toward the positive terminal of the battery 30.

Specifically, each time the second switch 34 is turned on (2 ndSW: on), the electric current that flows from the primary coil 2 toward the positive terminal of the battery 30 is added, and the primary current I1 increases on the negative end (time t07 to time t08).

Meanwhile, each time the primary current I1 increases on the negative end, the electric current that flows in the same direction as the secondary current flowing by the main ignition is sequentially added to the second coil 3 so that the secondary current I2 is maintained between the upper limit value and the lower limit value.

As described above, in the ignition apparatus 1 according to the present Example, the second switch 34 is controlled to be turned on and off to allow the secondary current to continuously flow to an extent such that the arc discharge can be maintained. As a result, in the ignition apparatus 1, when the discharge continuous signal IGw is kept on, the continuous spark discharge is maintained at the ignition plug 5.

Features of Example

Using the ignition apparatus 1 according to the present Example, the inventors conducted a great deal of research and development on the combination of the plasma device 10 with the ignition apparatus 1 including the first circuit 11 and the second circuit 12, and acquired the following knowledge as a result.

The inventors produced a plasma discharge in an air-fuel mixture and checked the relationship between the energy supply period and the amount of heat generation by ignition under the condition that the amount of energy supplied by the first circuit 11 and the second circuit 12 is constant. As a result, the inventors found that the amount of heat generation increases as the energy supply period becomes shorter, as shown in FIG. 5.

Figure 4A:
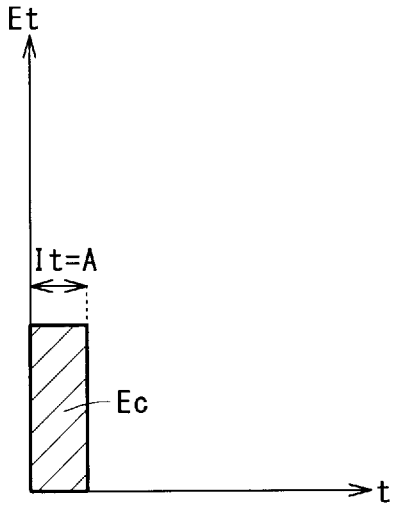
FIG. 4A illustrates the relationship between an energy supply period and an energy supply amount under the condition that the energy supply amount is constant.
Figure 4B:
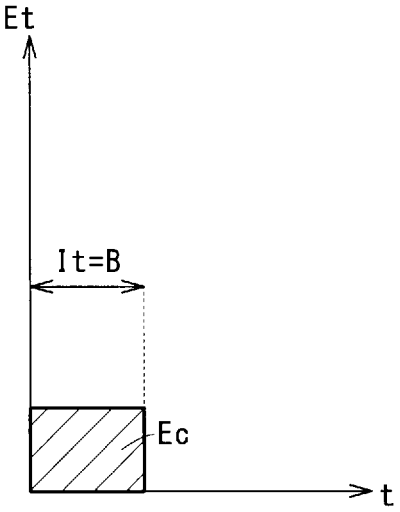
FIG. 4B illustrates the relationship between an energy supply period and an energy supply amount under the condition that the energy supply amount is constant.
Figure 4C:
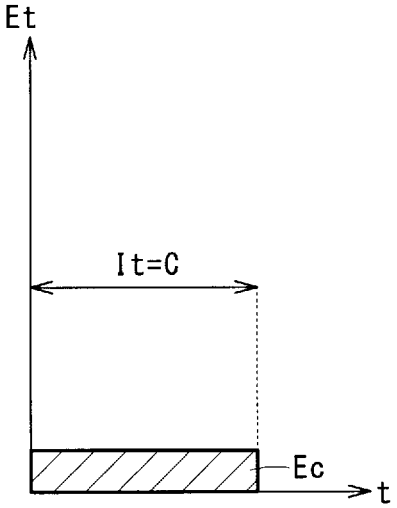
FIG. 4C illustrates the relationship between an energy supply period and an energy supply amount under the condition that the energy supply amount is constant.

Note that the graph of energy supplied by the first circuit 11 and the second circuit 12 has a rectangular shape, as shown in FIGS. 4A, 4B, and 4C. FIGS. 4A, 4B, and 4C show the relationship between an energy supply period It and an energy supply amount under the condition that the energy supply amount is constant. In FIGS. 4A, 4B, and 4C, the vertical axis represents an energy supply speed Et per unit time, the horizontal axis represents time t, and the area of the shaded portion represents the energy supply amount. The shaded portions in FIGS. 4A, 4B, and 4C have the same area, meaning that the energy supply amount is equal. Specifically, the energy supply amount has a constant value Ec.

As shown in FIG. 4A, the supply speed Et is high when the energy supply period It is short under the condition that the energy supply amount is constant. In contrast, as shown in FIG. 4B, the supply speed Et is low when the energy supply period It is long (A<B). Furthermore, as shown in FIG. 4C, the supply speed Et is lower when the energy supply period It is longer (B<C).

Figure 5:
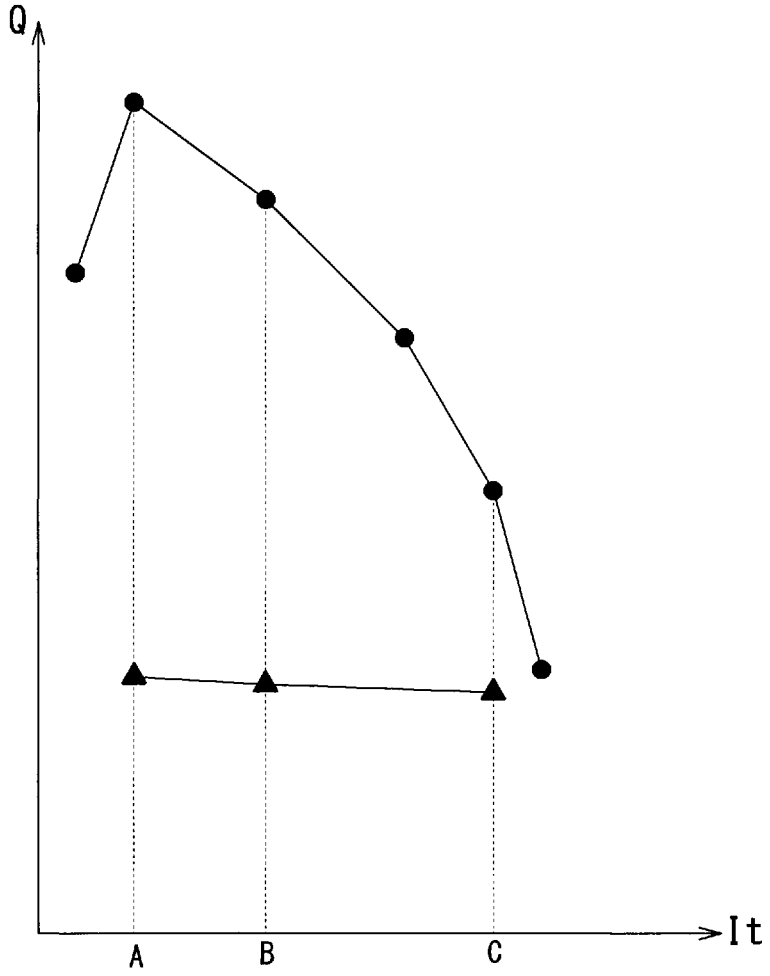
FIG. 5 is a diagram of correlation between the energy supply period and the amount of heat generation.

FIG. 5 shows the correlation between the energy supply period It and an amount of heat generation Q by the ignition under the condition that the energy supply amount has the constant value Ec as described above. In FIG. 5, the vertical axis represents the amount of heat generation Q, and the horizontal axis represents the energy supply period It.

The circle symbols in the figure represent the amount of heat generation Q obtained when the plasma device 10 is in operation. The triangular symbols in the figure represent, as a comparative example, the amount of heat generation Q obtained when the plasma device 10 is not in operation.

In the figure, A, B, and C correspond to the energy supply period It in FIG. 4A, the energy supply period It in FIG. 4B, and the energy supply period It in FIG. 4C, respectively.

As shown in FIG. 5, when the energy supply amount has the constant value Ec, the amount of heat generation Q is greater when the plasma device 10 is in operation than when the plasma device 10 is not in operation. The difference in the amount of heat generation between when the plasma device 10 is in operation and when the plasma device 10 is not in operation increases as the energy supply period It becomes shorter (in the order of C, B, and A).

Specifically, when the plasma device 10 is not in operation, the amount of heat generation Q hardly changes, regardless of the length of the energy supply period It. In contrast, when the plasma device 10 is in operation, the amount of heat generation Q increases as the energy supply period It becomes shorter in the order of C, B, and A. Thus, the difference in the amount of heat generation Q increases as the energy supply period It becomes shorter. The inventors acquired the above knowledge on the combination of the plasma device 10 with the ignition apparatus 1 including the first circuit 11 and the second circuit 12. As a result, the inventors found that, regarding the reduction in wear of the electrodes of the ignition plug 5, this produces a synergetic effect that is higher than or equal to the effect of mere combination.

Consequently, when the plasma device 10 is in operation, the energy supply period It can be short and the energy supply amount can be small, compared to when the plasma device 10 is not in operation.

Thus, in the first mode (the mode used when the plasma device 10 is in operation), the energy supply period It in which the energy is supplied by the first circuit 11 and the second circuit 12 can be made shorter than that in the second mode (the mode used when the plasma device 10 is not in operation). Furthermore, in the first mode, the amount of energy supplied by the first circuit 11 and the second circuit 12 can be smaller than that in the second mode.

[Method for Controlling Ignition Apparatus]

The method for controlling the ignition apparatus 1 according to the Example (the process for controlling the ECU 20 included in the control unit 13) will be described.

First, the control unit 13 determines whether the plasma device 10 is to be operated.

When the control unit 13 determines that the plasma device 10 is to be operated, the control unit 13 executes the first mode, while, when the control unit 13 determines that the plasma device 10 is not to be operated, the control unit 13 executes the second mode.

Note that whether the plasma device 10 is to be operated is determined on the basis of whether the plasma device 10 is malfunctioning or whether there is a need to use the plasma device 10, for example.

Here, the control unit 13 changes the frequency of a voltage to be applied between the electrode 16 and the electrode 17 in the plasma device 10, in accordance with the energy supply period It and the energy supply amount in the first mode.

Specifically, for example, when a reduction in the energy supply amount is desired, the control unit 13 increases the frequency of the voltage to be applied.

Advantageous Effects of Example

With the ignition apparatus 1 according to the present Example, when the plasma device 10 is in operation, the energy supply period It in which the energy is supplied to the ignition plug 5 can be short and the energy supply amount can be small, compared to when the plasma device 10 is not in operation. Thus, the ignition apparatus 1 including the plasma device 10 can reduce wear of the electrodes 8 and 9 of the ignition plug 5.

In the ignition apparatus 1 according to the present Example, the control unit 13 changes the frequency of the voltage to be applied between the electrode 16 and the electrode 17 in the plasma device 10, in according with the energy supply period It and the energy supply amount.

Accordingly, in the ignition apparatus 1, for example, even when a reduced amount of energy is supplied to the primary coil 2, the amount of heat generation Q can be maintained by increasing the frequency of a voltage to be applied between the electrodes in the plasma device 10. Thus, the ignition apparatus 1 according to the present Example can further reduce wear of the electrodes of the ignition plug 5.

In the ignition apparatus 1 according to the present Example, the fuel is injected upstream of the electrodes 16 and 17 of the plasma device 10 in the flow of the air-fuel mixture.

Accordingly, in the ignition apparatus 1, a plasma discharge can be produced in the fuel, and a hydrogen radical, a hydrocarbon radical, or the like can be generated. Thus, the ignition apparatus 1 according to the present Example can use a hydrogen radical, a hydrocarbon radical, or the like, which can further increase the amount of heat generation Q.

[Variation]

Various forms of embodiments (variations) of the ignition apparatus according to the present disclosure are possible within the scope of the essence of the present disclosure.

Figure 6:
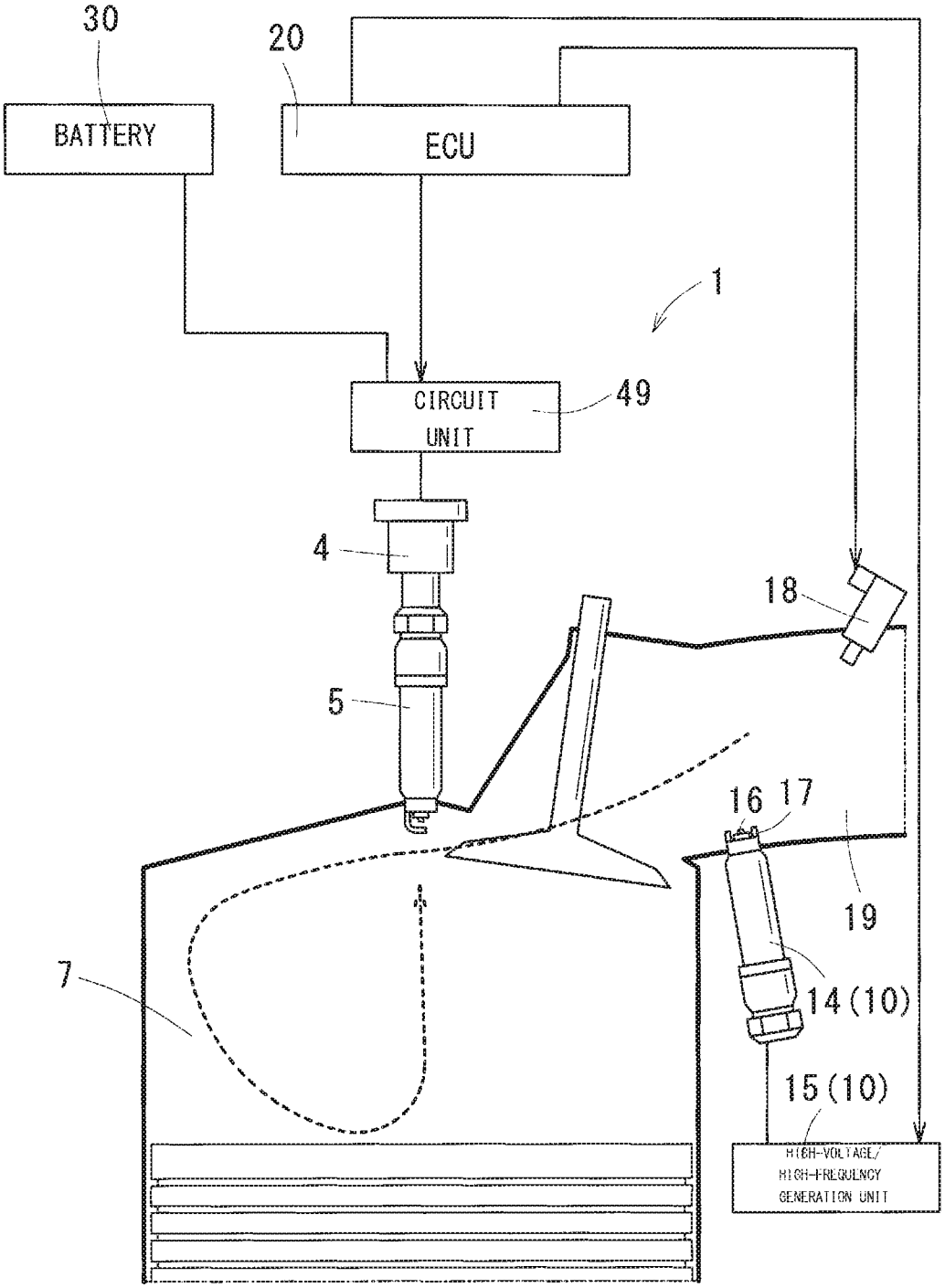
FIG. 6 is an overall configuration diagram showing an ignition apparatus and an internal combustion engine, according to a variation.

Although the discharge unit 14 of the plasma device 10 has the electrodes 16 and 17 provided in the combustion chamber 7 in the above-described Example, this is not limiting. For example, as shown in FIG. 6, the discharge unit 14 may be disposed in such a way that the electrodes 16 and 17 are provided in the intake air passage 19.

Figure 7:
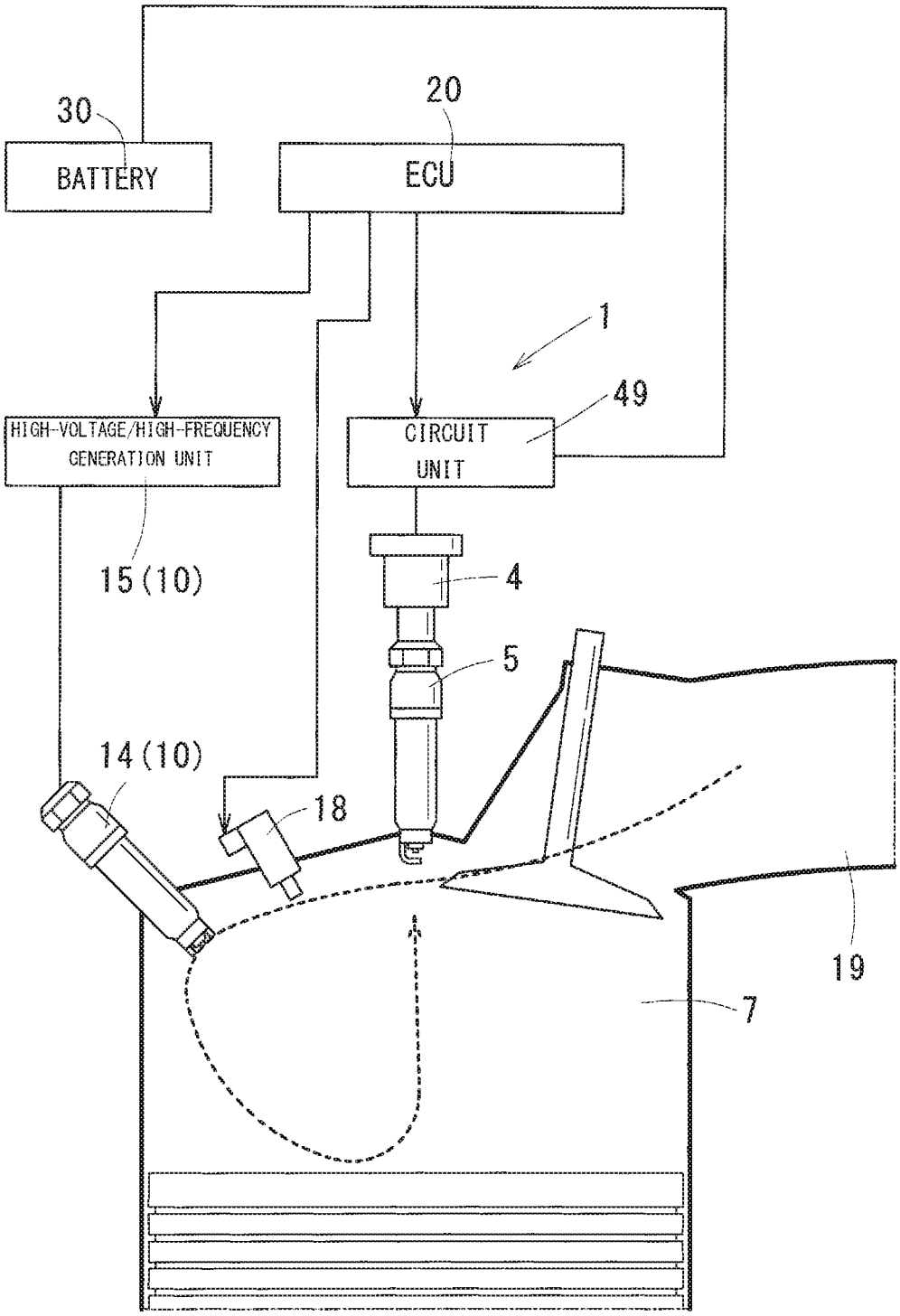
FIG. 7 is an overall configuration diagram showing an ignition apparatus and an internal combustion engine, according to a variation.

Furthermore, although the fuel injection valve 18 is provided in the intake air passage 19 in the above-described Example, this is not limiting. For example, as shown in FIG. 7, the fuel injection valve 18 may be disposed in such a way that the injection port is provided in the combustion chamber 7.

REFERENCE SIGNS LIST

1 Ignition apparatus
2 Primary coil
3 Secondary coil
4 Ignition coil
5 Ignition plug
6 Internal combustion engine
8 Center electrode (Electrode)
9 Earth electrode (Electrode)
10 Plasma device
11 First circuit
12 Second circuit
13 Control unit
14 Discharge unit
15 High-voltage/high-frequency generation unit
16 Center electrode (Electrode)
17 Earth electrode (Electrode)
18 Fuel injection valve
20 Electronic control unit (ECU)
30 Battery
49 Circuit unit

The invention claimed is:

1. An ignition apparatus for an internal combustion engine, comprising:

an ignition coil including a primary coil and a secondary coil; and an ignition plug connected to the secondary coil, wherein an arc discharge is produced in an air-fuel mixture using energy supplied between electrodes of the ignition plug by electromagnetic induction resulting from energization and de-energization of the primary coil, the ignition apparatus further comprising:

a plasma device which includes electrodes different from the electrodes of the ignition plug, and produces a plasma discharge in the air-fuel mixture before the arc discharge is produced;

a first circuit which energizes and de-energizes the primary coil to cause the ignition plug to start the arc discharge;

a second circuit which, during the arc discharge started by an operation of the first circuit, energizes the primary coil in a direction opposite to a direction of the energization by the first circuit, to maintain energization of the secondary coil in the same direction as a direction of the energization started by the operation of the first circuit and sequentially supply energy between the electrodes of the ignition plug to cause the arc discharge to continue; and a control unit which controls operations of the first circuit, the second circuit, and the plasma device, wherein the control unit has, as control modes for the first circuit and the second circuit, (a): a first mode used when the plasma device is operated and (b): a second mode used when the plasma device is not operated, and in the first mode, an energy supply period in which energy is supplied by the first circuit and the second circuit is shorter than the energy supply period in the second mode, and an energy supply amount which is an amount of energy supplied by the first circuit and the second circuit is smaller than the energy supply amount in the second mode.

2. The ignition apparatus according to claim 1, wherein in the first mode, the control unit changes a frequency of a voltage to be applied between the electrodes in the plasma device in accordance with the energy supply period and the energy supply amount.

3. The ignition apparatus according to claim 1, wherein fuel is injected upstream of the electrodes of the plasma device in a flow of the air-fuel mixture.

4. The ignition apparatus according to claim 1, wherein fuel is injected upstream of the electrodes of the plasma device in a flow of the air-fuel mixture.

5. The ignition apparatus according to claim 2, wherein fuel is injected upstream of the electrodes of the plasma device in a flow of the air-fuel mixture.

* * * * *